United States Patent [19]

Datta et al.

[11] 4,248,954

[45] Feb. 3, 1981

[54] COATED CARRIER PARTICLES FOR USE IN ELECTROPHOTOGRAPHIC PROCESS

[75] Inventors: Pabitra Datta, Cranbury, N.J.; Virgil W. Westdale, Chagrin Falls, Ohio; John Novotny, Jr., San Jose, Calif.

[73] Assignee: AM International, Inc., Los Angeles, Calif.

[21] Appl. No.: 831,148

[22] Filed: Sep. 7, 1977

[51] Int. Cl.[3] ..... B05D 1/04

[52] U.S. Cl. ..... 430/97; 430/108; 430/110; 430/137

[58] Field of Search ..... 427/14, 215, 216, 220, 427/221; 428/403, 404, 405, 406, 407; 260/42.14; 252/62.1 P; 430/108, 97, 110, 137

[56] References Cited

U.S. PATENT DOCUMENTS

| | | | |
|---|---|---|---|
| 3,554,932 | 1/1971 | Overcashier | 260/42.14 |
| 3,857,792 | 12/1964 | Madrid et al. | 252/62.1 P |
| 3,916,064 | 10/1975 | Brown | 252/62.1 P |
| 3,922,381 | 11/1975 | Datta | 252/62.1 P |
| 3,922,382 | 11/1975 | Kukla et al. | 252/62.1 P |
| 4,068,017 | 1/1978 | Westdale | 427/18 |

*Primary Examiner*—Shrive P. Beck

*Attorney, Agent, or Firm*—A. W. Karambelas; R. C. Curfiss

[57] ABSTRACT

Carrier particles for use in an electrophotographic process are prepared by coating the surface of the carrier particles with a perfluoro carboxylic acid in a polymeric binder. The resulting carriers are long lived and capable of imparting a positive triboelectric charge to electroscopic powders mixed therewith.

21 Claims, 3 Drawing Figures

COATED CARRIER PARTICLES FOR USE IN ELECTROPHOTOGRAPHIC PROCESS

BACKGROUND OF THE INVENTION

This invention relates to carriers for use in developer formulations which charge electroscopic powders triboelectrically. These carriers are useful in electrophotographic processes for developing latent electrostatic images in which a colored toner carried by the carrier particle is caused to be attracted from the carrier particle to develop the latent electrostatic image.

In the electrophotographic process it is necessary to use a carrier for the toner in order to produce an electrostatic charge upon the toner particles. Various kinds of developing processes are known including cascade, powder cloud and magnetic brush processes. In each of these processes it is necessary that the carrier used have certain triboelectric properties so that it is capable of imparting to the toner particles an electrostatic charge of the proper polarity and magnitude. It has been noted that when a developer mix containing toner and carrier is allowed to stand in the developing unit of a copying machine the toner loses its electrostatic charge over a period of time. When the copying machine is turned on, the first several copies made are of relatively poor quality until the triboelectric charge on the toner is again built up.

Recently, it has been found that the carrier particles can be coated with certain types of polymeric coatings to permit variation in the triboelectric properties thereof. One such method is disclosed in U.S. Pat. No. 3,811,880 to Luther C. Browning, assigned to the same assignee as this invention.

Although polymeric coatings of this type enable a certain degree of control of the triboelectric properties of the developer mix, it has been found that in use in the environment of electrophotographic reproduction machines such carrier particles are subject to aging which limits their effectiveness. Wearing away and removal of part of the polymeric coating upon the surface of the carrier particles is another problem encountered. This may result in undesired abrasion of the photoconductive surface used for imaging and also cause bias shorting.

Another problem inherent in the use of such polymeric coatings for carrier particles is the phenomenon known as "bound toner." Through a mechanism which is not clearly understood prolonged usage of developer mixes including polymeric coated carrier particles results in toner being adhered onto the surface of the coated carrier causing a decrease in the effectiveness of the toning process and hence in the overall development of the images being reproduced.

It is also known to use carriers in which a perfluoro carboxylic acid or derivative thereof is adhered to the surface of uncoated carrier particles by chemical adsorption. Such chemically treated carrier particles will impart a positive electrostatic charge to toner particles with which they are mixed. Carriers of this type are disclosed in U.S. Pat. No. 3,922,381 to Pabitra Datta, assigned to the same assignee as this invention. However, it has been found that in high speed electrophotographic reproduction machines the carrier particles coated with such perfluoro carboxylic acids are subject to abrasion, wear and flaking and the useful life thereof is impaired.

OBJECTS

It is accordingly an object of this invention to provide carriers for toners which are not subject to the disadvantages mentioned above.

Another object of this invention is to provide carrier particles which have an enhanced longevity.

Another object of this invention is to provide carrier particles which are capable of imparting desired triboelectric properties to various types of toners.

It is another object of this invention to provide carrier particles which combine the desired features of the prior art polymer coated carriers and the perfluoro carboxylic acid chemically treated carriers in a manner such that the useful life of the carrier particles is enhanced, desirable triboelectric properties are provided and "bound toner" is reduced.

It is a further object of this invention to provide a carrier which enables good copies to be made even though the developer mix containing the carrier and a toner is allowed to stand for a substantial period of time.

Other objects and advantages of this invention will become apparent in the following detailed disclosure and description.

SUMMARY OF THE INVENTION

Carrier particles coated with a perfluoro carboxylic acid in a polymeric binder can be used in developer mixes in order to increase the useful life of the developer and also to provide desired triboelectric properties by imparting a positive triboelectric charge to electroscopic powders mixed therewith. Such carriers have a longevity which is significantly greater than untreated carrier particles or carrier particles treated with perfluoro carboxylic acids alone. A more durable carrier, a more efficient carrier with respect to triboelectric properties, a carrier having low surface energy and a low coefficient of friction and a carrier which does not need to be replenished as frequently as other types of carriers is thereby provided.

DESCRIPTION OF THE PREFERRED EMBODIMENTS

Figure 1:
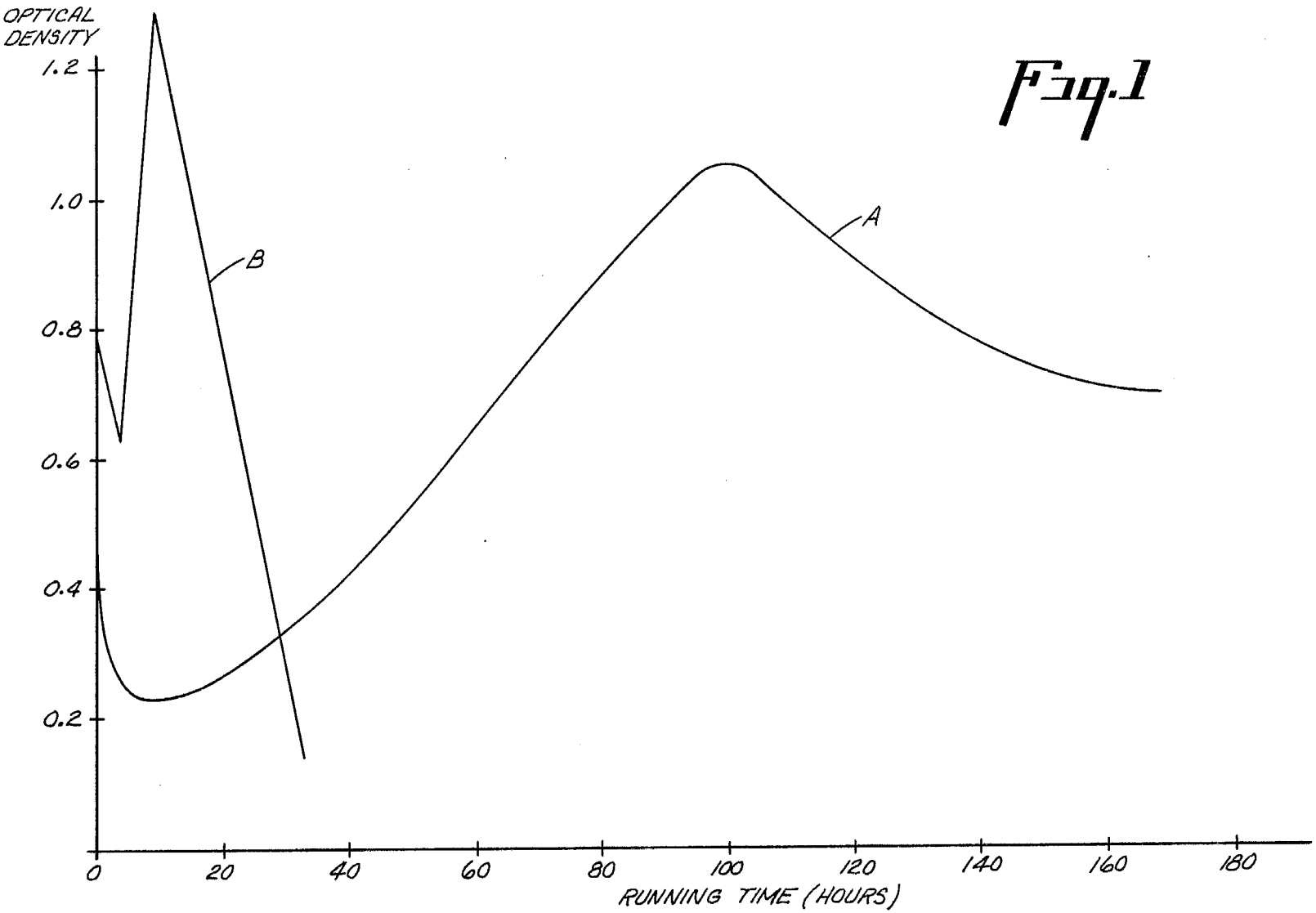
FIG. 1 is a series of curves showing variation in optical density of copies produced as a function of the running time of the developing unit of an electrophotographic copying machine for various types of carriers.

It has been found that the various problems encountered with previously available carriers are generally obviated by the use of a carrier particle to the surface of which is adhered a perfluoro carboxylic acid or derivative thereof in a polymeric binder.

The perfluoro acids contemplated by this invention are those perfluorinated and substantially perfluorinated carboxylic acids, both aliphatic and aromatic, which have carbon chains of from 3 to 18 carbon atoms in length. Examplary of such acids are perfluoropropionic acid, perfluorobutyric acid, perfluorovaleric acid, perfluoroadipic acid, perfluoroheptanoic acid, perfluorooctanoic acid, perfluorononanoic acid, perfluorodecanoic acid, 11-H-eicosafluroundecanoic acid, as well as the higher molecular weight aliphatic acids and aromatic acids such as perfluorobenzoic acid. Polycarboxylic acids can also be used, for example, perfluorosuccinic acid or perfluoroglutaric acid. Derivatives of perfluoro carboxylic acids such as salts, esters and amides can also be used.

As binders any of a wide variety of thermoplastic polymers which will not react with the carrier matrix materials can be used. Such materials increase the developer mix life up to about tenfold over that of carriers treated with perfluoro carboxylic acids alone and prevent toner filming and bias shorting. Some materials which are especially adapted for this purpose are vinyl resins, polycarbonate resins and other polyester resins, polyamide resins, polyurethane resins, epoxy resins, acrylic resins, novolak resins, heat curable silicone rubbers, fluorinated polymers and other thermoplastic polymers and copolymers.

A preferred class of such resins are the polyamide resins produced by reaction of dicarboxylic acids or their esters with the polyamine compounds such as diamines. Preferred esters are the methyl, ethyl and propyl esters. Suitable polyamine compounds include ethylenediamine, tetramethylene diamine, pentamethylenediamine, piperazine and diethylenetriamine. One group of particularly suitable polyamides sold under the trademark "VERSAMID" by General Mills Company are prepared from dimer acids and polyamines, for example the condensation product of 9,11-linoleic acid and 9,12-linoleic acid with ethylene diamine. Other suitable polyamide resins are available from the Krumbhaar Resin Division of Lawter Chemicals, Inc., under the trademark "POLYMID".

As carrier matrix materials it is possible to use a wide variety of substances, for example glass beads, ceramic beads, grains of sand or metallic particles. Non-metallic matrix materials are useful where a cascade development system is utilized although metallic matrices can also be used in cascade development. Where a magnetic brush developing system is used it is necessary that the matrix be magnetic. For this purpose various irons and steels have been used, for example, spherical steel beads and irregularly shaped iron powders.

The desired coating can be applied in a number of ways. In general, it is merely necessary to mix the carrier matrix material with a solution of the perfluoro carboxylic acid and polymeric binder. Ordinarily, adherence of the perfluoro acid and binder to the powder or bead occurs in a dilute solution of the perfluoro acid and binder in a suitable solvent such as an alcohol, ether, ketone, hydrocarbon or halogenated hydrocarbon at room temperature.

Coating of the carrier matrix material is accomplished by a process which will thoroughly mix the carrier matrix particles and the solution of perfluoro acid and binder to achieve uniform coating of the carrier matrix. A fluidized bed coating apparatus has been found particularly adaptable to the coating operation although other coating techniques can also be used. In using the fluidized bed coating method, the carrier matrix material is loaded into the fluidized bed coating apparatus and air under pressure is then passed into the apparatus. The solution of perfluoro acid and binder is pumped through an atomizing spray nozzle at a rate such that uniform coatings occur. Spraying may be repeated as many times as desired to obtain the particular thickness of coating required. The resulting coated particles are finally dried in a fluidized bed oven.

The matrix particles treated with a perfluoro acid and binder according to this invention are believed to constitute a thin film of the binder saturated with the perfluoro acid adhered to the surface of the matrix particle. A coating thickness, for example, of about from 1 micron to 3 microns has been found to be particularly satisfactory for use with a wide variety of toners.

In a preferred embodiment the perfluoro acid and resin binder are heated together to form a reaction product between the perfluoro acid and binder such that the adherence of the coating to the matrix particles is improved and the life of a developer mix into which such coated particles are incorporated is further increased. For this purpose the resin is melted and the perfluoro acid is added to the melted resin prior to dissolving in the solvent.

The resulting carriers are found to have a longer useful life than prior art carriers in the environment of electrophotographic development. Because these carriers have a low surface energy, reduced toner filming, characterized as "bound toner" is realized. In addition the adherence of the film of perfluoro carboxylic acid in resin binder to the carrier matrix material reduces flaking, chipping and spalling of the carrier.

Further, the triboelectric properties of the carriers of this invention are such that most toners will be charged with a positive polarity when used with these carriers. Even polytetrafluoroethylene (Teflon) and polyethylene can be charged positively using the carriers of this invention. Since most commercially available toners are less electronegative than Teflon or polyethylene they are charged with a positive polarity almost without exception.

With the outstanding triboelectric properties of the carriers of this invention and the physical properties mentioned above, namely the low surface energy, the low coefficient of friction and the pronounced adherence of the perfluoro carboxylic acid film to the carrier matrix material these carriers represent a significant improvement over carriers which have been previously used. In addition to the long life of the carriers themselves the particular combination of properties increases the life of the photoconductor used in the electrophotographic process and also results in very high quality copies being produced.

The durability and effectiveness of these carriers is greatly enhanced because of the coating of perfluoro carboxylic acid in resin binder upon the surface of the carrier matrix material.

Another advantage of the carriers of this invention is that the toner filming or "bound toner" determined using various commercially available toners with these carriers is considerably less than in the case of carrier particles which have been coated with low surface energy polymers such as polyvinylidene fluoride or silicones, which show little if any improvement over uncoated carrier matrix material. The low percentage of "bound toner" indicates that the carriers of this invention can be used much more successfully than previously available carriers since their efficiency is not reduced by toner filming upon the carrier particles to the same extent as prior art carriers.

This invention will be better understood by reference to the following examples which are intended to illustrate but not to unnecessarily limit the scope of the invention, which is defined in the claims appended hereto.

EXAMPLE 1

A 28 gram quantity of VERSAMID 935 polyamide resin supplied by General Mills Company was melted in a beaker at 130° C. To the fluid polyamide resin was added 12 grams of perfluorooctanoic acid (PFOA). The molten mixture was stirred for 20 minutes, cooled and dissolved in a mixture of 600 grams of methylene chloride and 200 grams of n-propanol. The resulting solution was stirred until a clear solution was obtained.

A 3 kilogram quantity of 175 micron average particle size spherical steel beads was cleaned with trichloroethane in an ultrasonic cleaner and then dried in a fluidized oven at 80° C. The cleaned and dried beads were then loaded into a fluidized bed coating apparatus, air was introduced at 15 cubic feet per minute and the frequency of the apparatus was adjusted to 6,000 rpm. The solution of PFOA-polyamide reaction product was pumped through an atomizing spray nozzle. About 500 grams of the solution was applied in 60 spray cycles at 5 minute intervals. The resulting coated carrier particles were then dried in a fluidized bed dryer at 100° C. for 2 hours.

EXAMPLE 2

A 4 kilogram quantity of 175 micron average particle size spherical steel beads was cleaned with trichloroethane in an ultrasonic cleaner and then dried in a fluidized oven at 80° C. The cleaned and dried beads were then poured into a solution of 4 g. of perfluorooctanoic acid (PFOA) in 800 g. of methanol and stirred for 2 hours. The alcoholic solution was then decanted and the resulting PFOA coated carrier particles were washed with an equivalent amount of methanol and dried in a fluidized bed oven at 60° C. for 1 hour.

EXAMPLE 3

A quantity of 150 grams of the coated carrier particles of Example 1 was mixed with 2.2 grams of a toner containing copolymers of styrene and n-butyl methacrylate, maleic modified rosin, polyvinyl stearate and carbon black. The mixture was poured into the toning unit of an IBM II electrophotographic copier. Zinc oxide coated electrostatic paper was charged negatively by means of a corona discharge using a potential of 5000 volts and exposed through a photographic transparency. The latent image was developed by passing through the toning unit. The optical density of the copies produced was determined by means of a Macbeth RD-519 densitometer.

A curve showing optical density as a function of the running time of the IBM II electrophotographic copier was plotted and is shown as Curve A of FIG. 1. One hour running time is equivalent to approximately 1,800 copies.

Using this developer mix excellent copies were produced up to about 200 hours running time, the equivalent of about 360,000 copies.

By way of comparison the results using spherical steel beads coated with PFOA alone as described in Example 2 are plotted in Curve B of FIG. 1.

Triboelectric properties of the toner subjected to frictional contact with the coated carrier particles of Example 1 were determined in the following manner.

A sheet of toner about 1 mm. thick was formed upon a steel plate by melting the toner onto the metal. The resulting toner sheet was then gently rubbed in the carrier and the carrier was removed by shaking or lightly vacuuming the toner sheet.

The triboelectric interaction between the toner sheet and carrier deposited a surface charge on the toner sheet. This surface charge caused a voltage drop across the toner sheet which was then measured with a non-contact voltmeter such as a Monroe Electronics "Isoprobe."

For a sheet of dielectric of area A, thickness t, dielectric constant K, and bulk resistivity P, with a surface charge density of $+(\sigma_c)$ on the top surface and $-(\sigma_c)$ on the bottom surface the equivalent circuit is a capacitor of capacity $$C=K\epsilon_o A/t$$

in parallel with a resistance $$R=Pt/A$$

with a voltage across the plates of:

$$V=(\sigma_c)t/K\epsilon_o$$

where $\epsilon_o$ is the permittivity of free space.

The surface charge density $\sigma_c$ associated with the toner-carrier triboelectric interaction was thus easily calculated from the measured voltage drop across the toner sheet, the dielectric constant and the thickness of the sheet.

The sheet thickness was determined by measuring the thickness of the sheet plus metal plate with calipers and substracting the measured thickness of the bare metal plate. The sheet dielectric constant was determined in the standard manner by (1) measuring the capacitance of the sheet placed between electrodes of known area and, (2) dividing that value by the calculated unloaded capacitance of the electrodes separated by a space equal to the sheet thickness.

Toner sheets made by carefully melting the toner powder onto the plate were often found to have edges slightly lower than the centers. In order to avoid any inaccuracies occasioned by the method of sheet preparation care was taken to measure the voltage only in the regions where the thickness was uniform and easy to measure.

Using the above described technique the surface charge density, $\sigma_c$, of the toner, due to triboelectric interaction between the toner sheet and the carrier of Example 1, was found to be $+1.3\times10^{-10}$ coulomb per square centimeter.

By way of comparison the surface charge density of this toner was found to be $-0.4\times10^{-10}$ coulomb per square centimeter when charged with uncoated spherical steel beads and $+1.3\times10^{-10}$ coulomb per square centimeter when charged with spherical steel beads coated with PFOA alone as described in Example 2.

EXAMPLE 4

A quantity of 1500 grams of the coated carrier particles prepared according to Example 1 was mixed with 22.5 grams of a toner containing polyamide resin, maleic modified rosin, styrene-allyl alcohol copolymer, polyethylene, lithium stearate, carbon black and a positive orienting dye. The mixture of coated carrier particles and toner was poured into the toning unit of an Addressograph Multigraph Model 2000 electrostatic copier. Zinc oxide coated electrostatic paper was charged negatively and exposed to light from a tungsten filament light bulb through a transparent glass target. The latent image was developed by passing through the toning unit four times. The optical density of the copies produced was determined by means of a Macbeth RD-519 densitometer.

Figure 2:
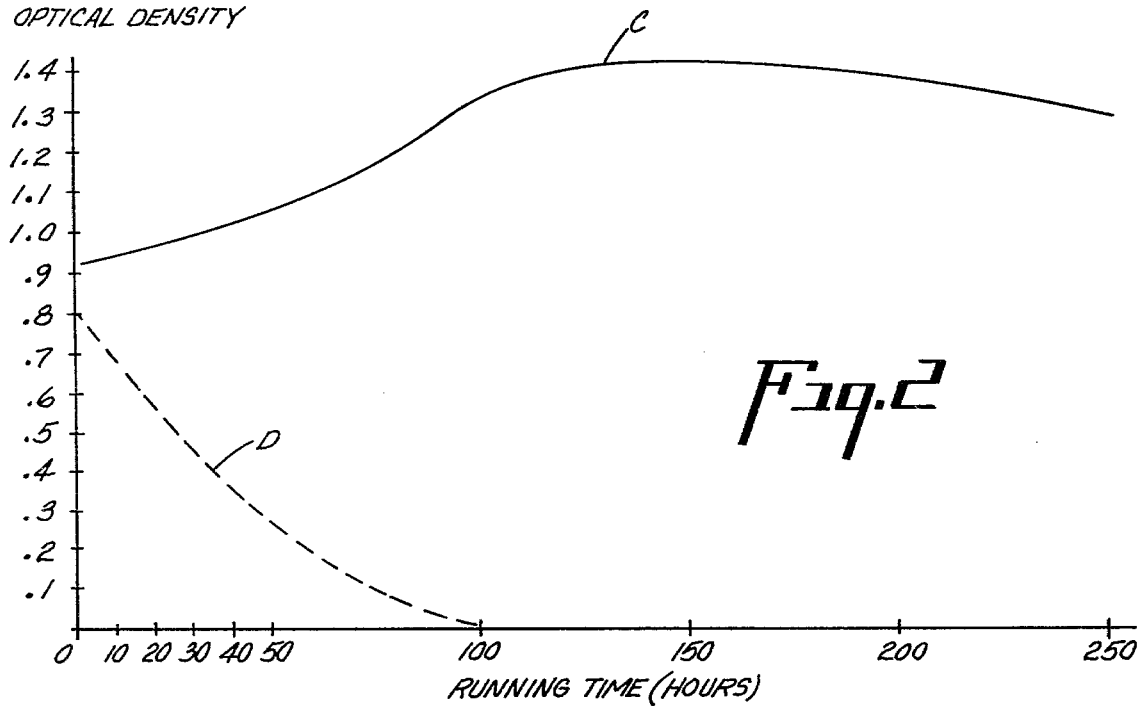
FIG. 2 is a series of curves showing variation in optical density of copies produced as a function of the running time of the developing unit of another electrophotographic copying machine for various types of carriers.

A curve showing optical density as a function of the running time of the Addressograph Multigraph Model 2000 electrostatic copier was plotted and is shown as Curve C of FIG. 2. One hour running time is equivalent to approximately 1,200 copies. Using this developer mix excellent copies were produced up to about 300 hours of running time, the equivalent of about 360,000 copies.

By way of comparison, the results using uncoated spherical steel beads are plotted in curve D of FIG. 2. It can be seen from this curve that the optical density drops off very rapidly to an unacceptable level when uncoated carrier particles are used.

Figure 3:
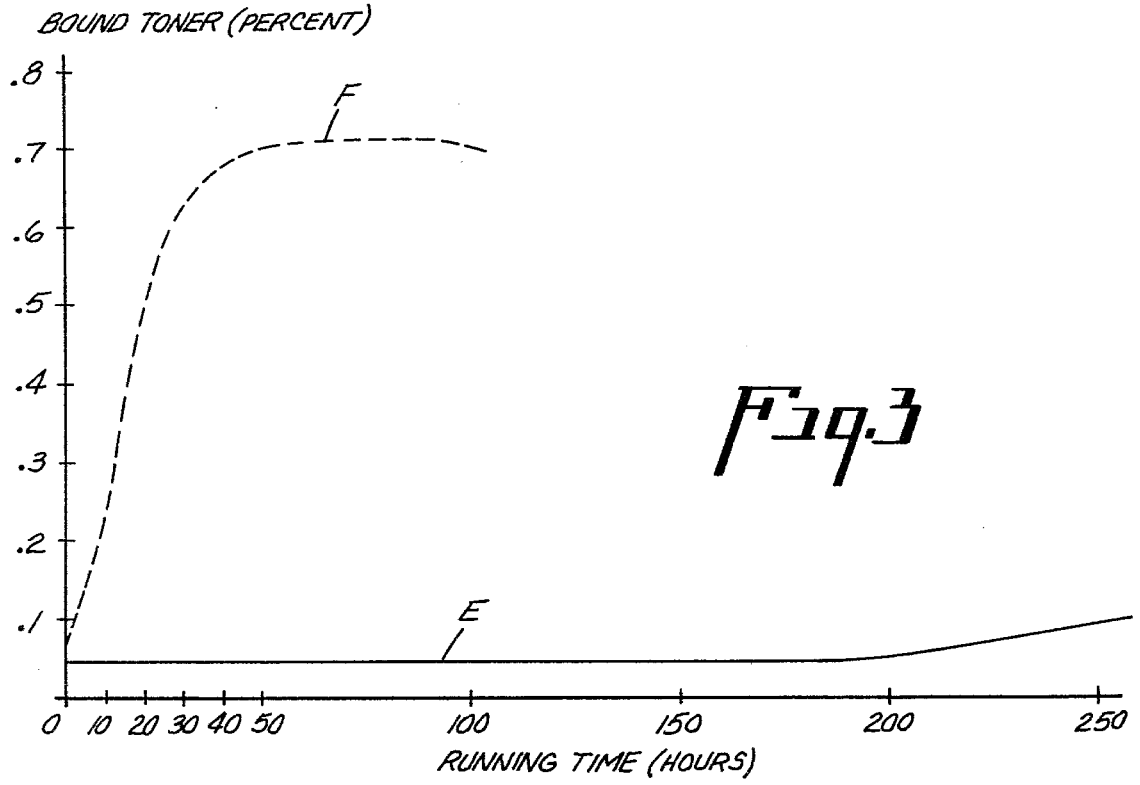
FIG. 3 is a series of curves showing bound toner as a function of the running time for various types of carriers.

Percentage of bound toner was determined using the analytical technique described in Denshi Shashin (Electrophotography) 10, 14 (1971). The analytical results were plotted and are shown in Curve E of FIG. 3 which shows the percentage of bound toner determined as a function of the running time. For comparison purposes the results using uncoated carrier particles are shown in Curve F of FIG. 3.

EXAMPLE 5

The procedure of Example 4 was followed except that a toner containing copolymers of styrene and butyl methacrylate, carbon black and a negative orienting dye was used. Positive images having an optical density of 1.1 were obtained.

EXAMPLE 6

The coated carrier particles of Example 1 were mixed in a ratio of 24:1 with a toner containing polyamide resin, maleic modified rosin, polyallyl alcohol, carbon black and a positive orienting dye and ball milled for various periods of time in an accelerated test for toner filming.

The results are shown in Table 1.

TABLE 1

| Time, hr. | Bound Toner, % |
|---|---|
| 0.5 | 0.04 |
| 1 | 0.08 |
| 4 | 0.08 |
| 48 | 0.5 |

EXAMPLE 7

A 5 gram quantity of poly(methylvinylether/maleic anhydride) manufactured and sold under the trademark GANTREZ 119 by General Aniline & Film Corporation was mixed with 100 grams of tetrahydrofuran and 100 grams of methyl ethyl ketone in a beaker equipped with a magnetic stirrer. A quantity of 1.5 grams of PFOA was added and the mixture was stirred until completely dissolved.

The resulting solution was applied to 2 kilograms of 175 micron average particle size spherical steel beads as described in Example 1.

The surface charge density of various polymers and toners was measured as described in Example 4. The results are shown in Table 2.

TABLE 2

| Polymer or Toner | Surface Charge Density $\times 10^{10}$, coulomb/cm$^2$ |
|---|---|
| Polytetrafluoroethylene | +17.5 |
| Polyethylene | +17.5 |
| Toner of Example 3 | +1.31 |
| Toner of Example 4 | +10.5 |
| Toner of Example 5 | +3.5 |
| Toner of Example 6 | +6.14 |

EXAMPLE 8

The procedure of Example 7 was repeated using 5 grams of a polycarbonate resin manufactured and sold under the trademark LEXAN by General Electric Company, 200 grams of chloroform and 1.5 grams of PFOA. The results are shown in Table 3.

TABLE 3

| Polymer or Toner | Surface Charge Density $\times 10^{10}$ coulomb/cm$^2$ |
|---|---|
| Polytetrafluoroethylene | +4.5 |
| Polyethylene | +7.0 |
| Toner of Example 3 | +3.0 |
| Toner of Example 4 | +1.8 |
| Toner of Example 5 | +4.4 |
| Toner of Example 6 | +4.4 |

EXAMPLE 9

The procedure of Example 7 was repeated using 16 grams of a solvent solution of a curable dimethyl polysiloxane manufactured and sold under the trademark SS-4164 by General Electric Company, 100 grams of acetone, 100 grams of tetrahydrofuran and 1.5 grams of PFOA. The dimethyl polysiloxane was catalyzed by adding 0.5 gram of General Electric catalyst SS-4163 C before coating on the steel beads. The results are shown in Table 4.

TABLE 4

| Polymer or Toner | Surface Charge Density $\times 10^{10}$ coulomb/cm$^2$ |
|---|---|
| Polytetrafluoroethylene | +1.0 |
| Polyethylene | +8.7 |
| Toner of Example 3 | +0.3 |
| Toner of Example 4 | +3.0 |
| Toner of Example 5 | +2.6 |
| Toner of Example 6 | +2.2 |

EXAMPLE 10

The procedure of Example 7 was repeated using 5 grams of a polyurethane resin manufactured and sold under the trademark ESTANE by B. F. Goodrich Company, 100 grams of acetone, 100 grams of tetrahydrofuran and 1.5 grams of PFOA. The results are shown in Table 5.

TABLE 5

| Polymer of Toner | Surface Charge Density $\times 10^{10}$ coulomb/cm$^2$ |
|---|---|
| Polytetrafluoroethylene | +17.0 |
| Polyethylene | +17.0 |
| Toner of Example 3 | +4.0 |
| Toner of Example 4 | +12.5 |
| Toner of Example 5 | +14.0 |
| Toner of Example 6 | +17.0 |

It can thus be seen that the carriers of this invention can be used to produce good positive copies using a variety of toners. Particularly noteworthy are the apparent ability of the carriers of this invention to impart a positive charge to most types of toners and the long life of such carriers.

This invention has been described with respect to a limited number of specific embodiments. However, it is intended that alternative compositions and methods may be used and it is to be understood that this invention is not to be limited except in accordance with the claims appended hereto.

We claim:

1. A carrier for use in electrophotographic development of latent electrostatic images capable of inducing an electrostatic charge in a toner mixed therewith which comprises a core member selected from the group consisting of metallic particles and siliceous particles to the surface of which is adhered a surface member selected from the group consisting of perfluorinated and substantially perfluorinated carboxylic acids containing from 3 to 18 carbon atoms and salts, esters and amides thereof in a polymeric binder therefor wherein said polymeric binder is selected from the group consisting of polycarbonate resins, polyester resins, polyamide resins, polyurethane resins, epoxy resins, acrylic resins, novolak resins, and heat curable silicone rubbers.

2. A composition according to claim 1 wherein said acid is perfluorooctanoic acid.

3. A composition according to claim 1 wherein said acid is perfluoropropionic acid.

4. A composition according to claim 1 wherein said acid is perfluorobutyric acid.

5. A composition according to claim 1 wherein said acid is perfluorodecanoic acid.

6. A composition according to claim 1 wherein said acid is 11-H-eicosafluoroundecanoic acid.

7. A composition according to claim 1 wherein said acid is perfluoroglutaric acid.

8. A composition according to claim 1 wherein said amide is perfluoroacetamide.

9. A composition according to claim 1 wherein said charge is of positive polarity.

10. A composition according to claim 1 wherein said particles are magnetic.

11. A composition according to claim 1 wherein said particles are non-magnetic.

12. A composition according to claim 1 wherein said particles are iron.

13. A composition according to claim 1 wherein said particles are spherical steel beads.

14. A composition according to claim 1 wherein said binder is a polyester comprising a copolymer of methyl vinyl ether and maleic anhydride.

15. A composition according to claim 1 wherein said binder is a polycarbonate resin.

16. A composition according to claim 1 wherein said binder is a silicone.

17. A composition according to claim 1 wherein said binder is a polyurethane resin.

18. A process for developing a latent electrostatic image which comprises mixing an electroscopic powder with a carrier comprising a member selected from the group consisting of metallic particles and siliceous particles to the surface of which is adhered a member selected from the group consisting of perfluorinated and substantially perfluorinated carboxylic acids containing from 3 to 18 carbon atoms and salts, esters and amides thereof in a polymeric binder therefor wherein said polymeric binder is selected from the group consisting of, polycarbonate resins, polyester resins, polyamide resins, polyurethane resins, epoxy resins, acrylic resins, novolak resins and heat curable silicone rubbers, to impart electrostatic charges to said electroscopic powder and said carrier, whereby said electroscopic powder is attracted to said carrier and transferring said electroscopic powder from said carrier to said latent electrostatic image.

19. A process according to claim 18 wherein a positive electrostatic charge is imparted to said electroscopic powder.

20. A carrier for use in electrophotographic development of latent electrostatic images capable of inducing an electrostatic charge in a toner mixed therewith which comprises a core member selected from the group consisting of metallic particles and siliceous particles to the surface of which is adhered a surface member selected from the group consisting of perfluorinated and substantially perfluorinated carboxylic acids containing from 3 to 18 carbon atoms and salts, esters and amides thereof in a polyamide binder therefor.

21. A process for developing a latent electrostatic image which comprises mixing an electroscopic powder with a carrier comprising a member selected from the group consisting of metallic particles and siliceous particles to the surface of which is adhered a member selected from the group consisting of perfluorinated and substantially perfluorinated carboxylic acids containing from 3 to 18 carbon atoms and salts, esters and amides thereof in a polyamide binder therefor to impart opposite electrostatic charges to said electroscopic powder and said carrier, whereby said electroscopic powder is attracted to said carrier and transferring said electroscopic powder from said carrier to said latent electrostatic image.

* * * * *